US005278369A

United States Patent [19]

Spanio

[11] Patent Number: 5,278,369

[45] Date of Patent: Jan. 11, 1994

[54] ELECTRICAL OPERATING DEVICE WITH CONTACT-HOLDING SLIDER IN TWO PARTS

[75] Inventor: Marino Spanio, Milan, Italy

[73] Assignee: Bremas S.p.A., Italy

[21] Appl. No.: 906,371

[22] Filed: Jun. 30, 1992

[51] Int. Cl.[5] ..... H01H 1/20

[52] U.S. Cl. ..... 200/243; 200/247; 200/16 A

[58] Field of Search ..... 200/239, 243, 244, 245, 200/247, 250, 290, 16A, 16C, 533, 534, 530, 549, 573, 240, 241, 242, 248, 249, 252, 253, 280, 281 200/447, 449, 450

[56] References Cited

U.S. PATENT DOCUMENTS

| | | | |
|---|---|---|---|
| 4,405,848 | 9/1983 | Jaegle | 200/243 |
| 4,616,117 | 10/1986 | Kleine | 200/243 |
| 4,650,935 | 3/1987 | Ootsuka et al. | 200/243 X |
| 4,746,779 | 5/1988 | Drexler et al. | 200/243 X |

FOREIGN PATENT DOCUMENTS

| | | | |
|---|---|---|---|
| 554587 | 3/1958 | Canada | 200/243 |
| 3326427 | 2/1985 | Fed. Rep. of Germany | 200/243 |
| 3522090 | 1/1986 | Fed. Rep. of Germany | 200/243 |

*Primary Examiner*—Henry J. Recla
*Assistant Examiner*—Glenn T. Barrett
*Attorney, Agent, or Firm*—Steinberg & Raskin

[57] ABSTRACT

An electrical operating device, particularly a change-over or other switch or the like, including a contact-holding slider having a body provided with usual recesses which open into two opposing faces (A, B) of the body, and contain usual contact elements (40) which move against elastic springs (26, 26A) to cooperate with usual fixed contacts rigid with the body of the operating device, the body of the slider comprising at least two parts (2, 3) fitted together by connection devices (4, 4', 5, 5', 6, 6', 7, 7').

19 Claims, 1 Drawing Sheet

ELECTRICAL OPERATING DEVICE WITH CONTACT-HOLDING SLIDER IN TWO PARTS

BACKGROUND OF THE INVENTION

This invention comprises an electrical operating device, in particular a change-over or other switch or the like.

Such devices generally comprise a contact-holding slider arranged to cooperate with a camshaft and provided with recesses which open into two opposing faces of the slider body, and within which generally flat contact elements move against springs, to project via their opposing ends from said recesses.

Sliders of this type have been known for some time and have been used for many years in such electrical components.

Known sliders consist of a single body provided with said recesses, which contain counteracting springs acting on contact elements. These sliders are generally not easy to assemble. In this respect, the insertion of the springs and contact elements into said recesses is laborious and lengthy, particularly because of their small size.

This obviously negatively affects the cost of the finished electrical component (change-over or other switch) and the time required for producing one of these components.

OBJECTS AND SUMMARY OF THE INVENTION

An object of the present invention is to provide a slider of the aforesaid type, of which the production time and cost are less than those involved in the assembly of known sliders.

This and further objects which will be apparent to the expert of the art are attained by an electrical operating device, particularly a change-over or other switch or the like, comprising a contact-holding slider, characterised in that the body of said slider comprises at least two parts fitted together by connection means. In a slider of this type, the usual elastic counteracting means (for example springs) and the contact elements can be inserted into the relative recesses easily rather than laboriously. The time required for assembling such an operating device is therefore less than for devices using conventional sliders.

This obviously results in reduced cost of the finished device.

BRIEF DESCRIPTION OF THE DRAWINGS

The present invention will be more apparent from the accompanying drawing, which is provided by way of non-limiting example and in which.

DETAILED DESCRIPTION OF THE INVENTION

Figure 2:
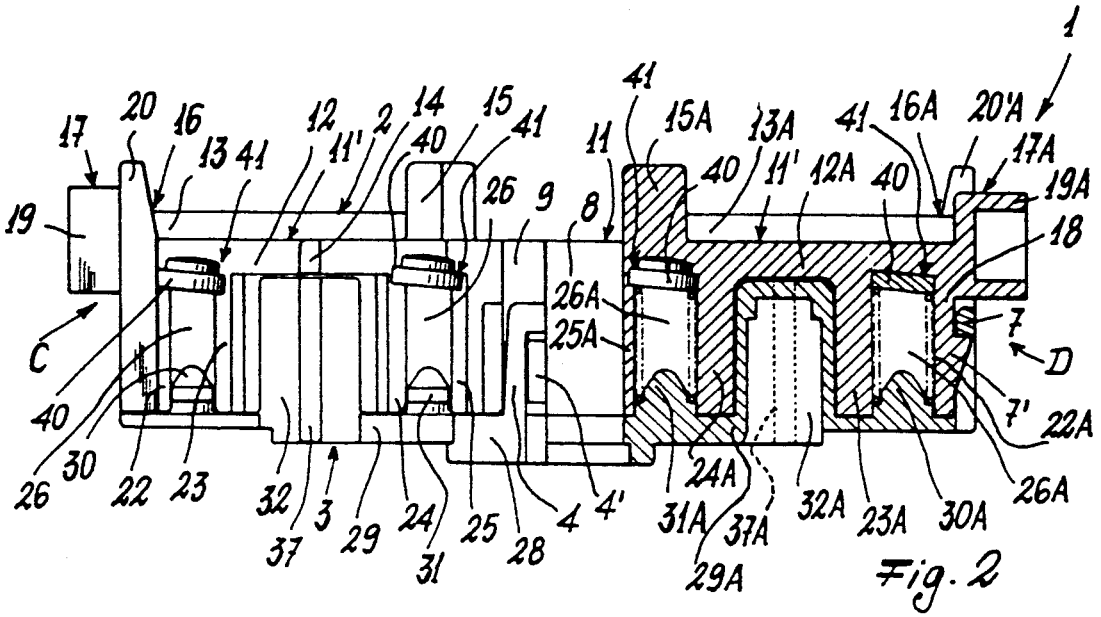
FIG. 2 is a front view thereof shown in partial section on the line 2—2 of FIG. 1.

With reference to said figures, the slider according to the invention comprises an upper part 2 and a lower part 3 (FIG. 2) which are snap-fitted together by tangs 4, 5, 6, 7 (FIGS. 1, 2, 3) and relative steps 4'. 5'. 6', 7' (into which the tangs are snap-inserted) arranged in the manner described hereinafter on those slider faces indicated by the arrows A, B, C and D respectively.

The upper part 2 comprises a hollow cylindrical central body 8 (FIGS. 1 and 2), the outer surface of which comprises in the faces A and B (FIG. 1) two rectangular recesses 9 and 10 for supporting and guiding the tangs 4 and 5 respectively, when the parts 2 and 3 are fitted together. The outer surface of the cylindrical body 8 is also provided with two further recesses 25, 25A which are arched (shown dashed in FIG. 1).

Figure 1:
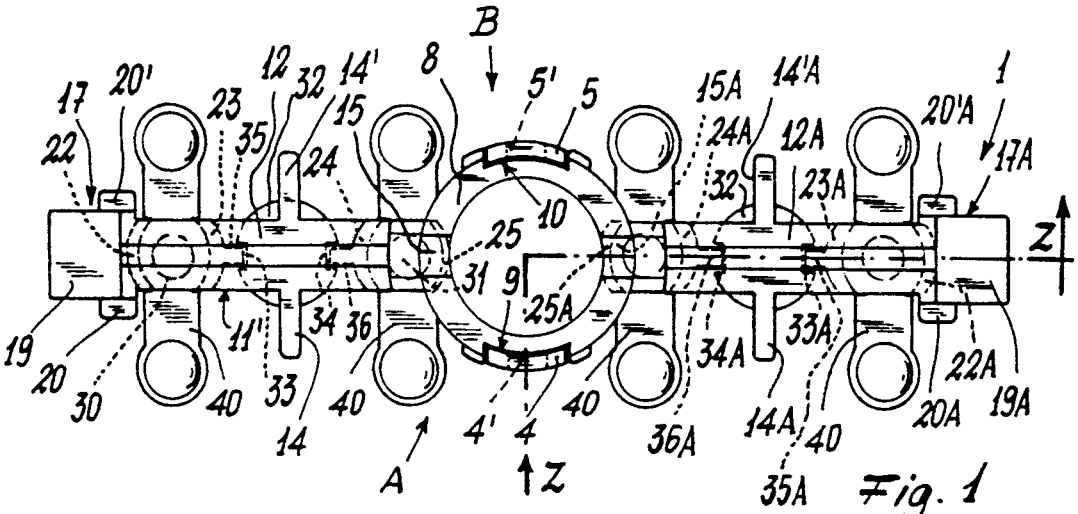
FIG. 1 is a plan view of the slider according to the invention.
Figure 3:
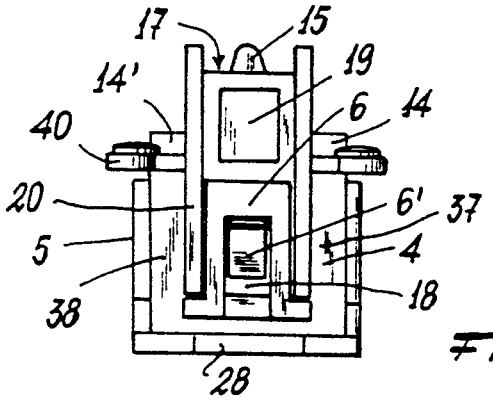
FIG. 3 is a side view thereof in the direction of the arrow C of FIG. 2.

From the upper end 11 (FIG. 2) of the cylindrical body 8 there extend two diametrically positioned identical arms 12 and 12A (FIGS. 1 and 2). In the following description those elements common to both arms are indicated by the same number, but followed by the letter A when relative to the arm 12A.

A stiffening rib 13 is provided longitudinally on the upper face 11' (FIG. 2) of the arm 12. From the arm 12 there also extend two portions 14 and 14' (FIG. 1) which cross the main axis of the arm and are arranged to cooperate with suitable guides (not shown) provided in the body of an operating device to which the slider is applied. A pin 15 (FIG. 2) is provided in correspondence with the joint between the arm 12 and the cylinder 8 on the upper face 11' to cooperate with the cams of a usual camshaft (not shown) for moving the slider according to the invention.

The free end 16 (FIG. 2) of the arm 12 is provided with a further element 17 for cooperating with suitable guides (not shown) provided on the body of the operating device which uses the slider.

The element 17 comprises (FIGS. 2 and 3) a hollow element 19 of parallelepiped shape, a substantially flat wall 18 and two connection portions 20, 20' between said parallelepiped 19, the wall 18 and the end 16 of the arm 12. Said three parts of the element 17 all cooperate with guides (not shown) suitably provided in the body of the operating device to which the slider is applied.

In the face of the wall 18 (FIG. 3) there is a step 6', the opposite face to this being provided with an arched guide 22 (shown dashed in FIG. 1).

On that face facing the lower part 3 of the slider, the arm 12 is provided with two arched elements 23, 24 (shown full in FIG. 2 and dashed in FIG. 1) which together with the arched guide 22 and the arched recesses 25 defines two semi-cylindrical surfaces acting as guide and support for the counteracting springs 26 and as a centering member for the usual contact bridges 40 (FIG. 2). The base (indicated by the arrow 41 in FIG. 2) of said semi-cylindrical surfaces is slightly inclined such that when the slider has been assembled, the usual contact bridges 40 are also slightly inclined (as in FIG. 2).

The lower part 3 (FIG. 2) comprises substantially a circular body 28 (FIG. 2) and two arms 29, 29A (FIG. 2) extending from the circular body 28.

The body 28 and arms 29, 29A are dimensioned and arranged such that when the slider has been assembled they are exactly opposite the cylindrical body 8 and the arms 12, 12A respectively of the upper part 2 of the slider.

From the circular body 28 there extend two tangs 4 and 5 (FIGS. 1 and 2) for its snap-fitting to the upper part 2 of the slider. The arm 29 comprises two frusto-conical supports 30, 31 (FIG. 2) for retaining the spring 26, a hollow cylinder 32 (FIG. 2) and the tang 6 (FIG. 3) for snap-fitting the two slider parts 2 and 3 together.

The cylinder 32 comprises in its outer surface two recesses (33, 34) shown dashed in FIG. 1) to act as guides for the ribs 35, 36 of the arched elements 23, 24 when the slider is assembled. The cylinder 32 is also provided with two projecting portions 37, 38 (FIGS. 2 and 3), of which when the slider has been assembled those ends facing the part 2 mate with the analogous portions 14, 14' extending from the upper arm 12.

When the slider has been assembled and fitted to the electrical operating device, a counteracting spring (not shown) is inserted into the cavity of the cylinder 32 (FIG. 2, sectioned part). The slider of the invention is assembled in the following manner. The part 2 is laid on a surface with the face 11 facing the surface (inverted with respect to FIG. 2). Four usual contact bridges 40 and the four springs 26 are then arranged in contact with the cylindrical surfaces defined by the arched elements 22, 23, 24, 25, 25A, 24A, 23A, 22A.

The part 3 of the slider is then fitted by snapping the tangs 4, 5, 6, 7 into the relative steps 4', 5', 6', 7' and sliding the ribs 35, 36, 35A, 36A into the recesses 33, 34, 33A, 34A. In this manner the slider can be assembled easily and rapidly and can then be used in the operating device, particularly in a switch.

I claim:

1. A contact-holding slider for an electric operating device, comprising:

a contact-carrying body having first and second snap-engaging portions, said contact-carrying body having a cylindrical central portion having a through passage arranged along a longitudinal axis, said through passage being defined by said first and second snap-engaging portions when said first and second snap-engaging portions are snap-engaged to each other, said contact-carrying body further comprising mutually aligned first and second arms extending from said cylindrical central portion, sliding means arranged at ends of said first and second arms for guiding said contact-carrying body along the longitudinal axis of said through passage, spring receiving seats arranged on said first and second arms and being defined by said first and second snap-engaging portions when said first and second snap-engaging portions are snap-engaged to each other, each of said spring receiving seats supporting a spring and comprising opposed, extending apertures, and contact means for establishing electrical contact slidably supported in each of said spring receiving seats and extending from said apertures such that said springs apply a force against said contact means.

2. The device of claim 1, wherein said first snap-engaging portion is a lower part of said body and said second snap-engaging portion is an upper part of said body, said contact-carrying body further comprising connecting means to connect said upper part to said lower part.

3. The device of claim 2, wherein said connection means comprise tangs arranged on said lower part and corresponding steps arranged on said upper part such that said tangs are snap-inserted into said corresponding steps when said upper part is engaged with said lower part.

4. The device of claim 3, wherein said upper part comprises said cylindrical central portion and said cylindrical central portion comprises recesses arranged on an outer surface thereof for supporting and guiding a pair of said tangs into said upper part.

5. The device of claim 2, wherein said first and second arms are arranged on said upper part and corresponding first and second arms are arranged on said lower part.

6. The device of claim 2, wherein said spring receiving seats are arranged in said upper part and said lower part comprises frusto-conical supports aligned with said spring receiving seats for retaining said springs in said spring receiving seats when said lower part is connected to said upper part.

7. The device of claim 2, further comprising seat means arranged on said lower part for retaining additional springs acting on said body.

8. The device of claim 7, wherein each of said spring receiving seats comprises a pair of opposing arched elements defining semi-cylindrical surfaces and arranged as a centering member for said contact means, said arched elements comprising ribs arranged on a surface opposite to a surface facing said contact means, said ribs engaging with recesses formed on said seat means.

9. The device of claim 1, further comprising stiffening ribs arranged on said first and second arms.

10. The device of claim 1, wherein said sliding means are arranged to connect said device to an electric operating device.

11. The device of claim 1, further comprising connection means arranged to connect said device to an electric operating device.

12. The device of claim 11, wherein said connection means comprise portions arranged on said upper part in a direction perpendicular to a main axis of said first and second arms.

13. The device of claim 1, further comprising pins arranged on an upper face of said contact-carrying body in vicinity of a contact point between said cylindrical central portion and each of said first and second arms, said pins cooperating with a camshaft of an operating electric device such that said device is movable via said pins.

14. The device of claim 1, wherein each of said spring receiving seats comprises a pair of opposing arched elements defining semi-cylindrical surfaces and arranged as a centering member for said contact means.

15. The device of claim 14, wherein a base of said semi-cylindrical surfaces is inclined such that said contact means are inclined when inserted into said semi-cylindrical surfaces.

16. The device of claim 1, wherein said contact means comprise contact bridges.

17. A contact-holding slider for an electric operating device, comprising:

a contact carrying body having an upper part, a lower part, first connection means for connecting said upper part to said lower part, a cylindrical central portion including a through passage having a longitudinal axis, said through passage being defined by said upper part and said lower part when said upper part and said lower part are connected by said first connection means, first and second arms arranged on said upper part and extending from said cylindrical portion, spring receiving seats arranged on said first and second arms for supporting a spring and comprising opposed, extending apertures, said spring receiving seats being defined by said upper part and said lower part when said upper part and said lower part are connected by said first connection means, second connection means arranged on said first and second arms for guiding said body along the longitudinal axis of said through passage and connecting said body to an electric operating device, and contact means for establishing electrical contact slidably supported in each of said spring receiving seats and extending from said apertures, said springs in each of said spring receiving seat acting against said contact means.

18. The device of claim 17, wherein said first connection means comprise tangs arranged on said lower part and corresponding steps arranged on said upper part such that said tangs are snap-inserted into said corresponding steps when said upper part is engaged with said lower part.

19. The device of claim 17, wherein said spring receiving seats are arranged in said upper part and said lower part comprises frusto-conical supports aligned with said spring receiving seats for retaining said springs in said spring receiving seats when said lower part is connected to said upper part.

* * * * *